United States Patent [19]

Takamura

[11] Patent Number: 4,631,903

[45] Date of Patent: Dec. 30, 1986

[54] WRAPPING MACHINE AND METHOD OF FOLDING WRAPPING FILM IN WRAPPING MACHINE

[75] Inventor: Yoshiyuki Takamura, Nagoya, Japan

[73] Assignee: Fuji Pack System Ltd., Nagoya, Japan

[21] Appl. No.: 801,168

[22] Filed: Nov. 22, 1985

[30] Foreign Application Priority Data

Nov. 30, 1984 [JP] Japan ..... 59-254797

[51] Int. Cl.[4] ..... B65B 11/18

[52] U.S. Cl. ..... 53/466; 53/442; 53/556; 53/228

[58] Field of Search ..... 53/442, 466, 228, 230, 53/206, 556

[56] References Cited

U.S. PATENT DOCUMENTS 4,178,740 12/1979 Groom ..... 53/228 X 4,548,024 10/1985 Fine ..... 53/441

FOREIGN PATENT DOCUMENTS 58-90010 5/1983 Japan .

*Primary Examiner*—John Sipos

*Attorney, Agent, or Firm*—Jordan and Hamburg

[57] ABSTRACT

A wrapping machine comprises: front and rear folding members movable relative to each other in the longitudinal direction of the machine; a pair of lateral folding members respectively positioned at both lateral sides of the rear folding member, the lateral folding members being opened and closed with respect to each other in response to the longitudinal movement of the rear folding member; a folding area defined between the front and rear folding members and the pair of lateral folding members, in which folding area the edge portions of a piece of wrapping film are gathered together tightly underneath an object to be wrapped; and a pair of mounting members positioned above the pair of lateral folding members, respectively, and entering the space underneath the object so as to mount the same thereon before all of the folding members enter the space underneath the object so as to fold the piece of wrapping film.

6 Claims, 25 Drawing Figures

WRAPPING MACHINE AND METHOD OF FOLDING WRAPPING FILM IN WRAPPING MACHINE

BACKGROUND OF THE INVENTION

1. Field of the Invention

The present invention relates to a wrapping machine and, more particularly, to a vegetable and fruit wrapping machine for wrapping a soft or flexible tray. The present invention also pertains to a method of folding a tray in a piece of wrapping film clamped and stretched over a wrapping area defined in such a wrapping machine, thereby wrapping an object to be wrapped.

2. Description of the Prior Art

In a conventional wrapping machine, for example, one disclosed in the specification of Japanese Patent Laid-Open No. 90010/1983, a piece of wrapping film is stretched over a wrapping area defined in the machine, and both lateral edges of the film are respectively clamped by front and rear pressing members. When, in this state, a tray on a delivery means is pushed up to a wrapping position, the film is tensely stretched while covering the tray from the upper side thereof. Then, the edge portions of the film are gathered together tightly underneath the tray by a folding means, thereby wrapping the tray with the film. More specifically, the folding means in the above wrapping machine, for example, is arranged such that a movable rear folding member is longitudinally moved relative to a fixed front folding member so as to come toward and away from the latter, and right and left folding members are opened and closed with respect to each other below the rear folding member in response to the longitudinal movement of the rear folding member. Further, a multiplicity of mounts for mounting objects to be wrapped are provided on the delivery means so as to project therefrom upwardly, the mounts being able to tilt inwardly when abutting against the rear folding member and the right and left folding members.

When the rear folding member is advanced and the right and left folding members are closed or moved toward each other, these folding members push a piece of wrapping film toward the underside of a tray placed on the mounts and abut against these mounts so as to tilt the same. Simultaneously with this tilting operation, the delivery means is moved downwardly. In consequence, the tray is gradually transferred to the rear folding member from the rear end of its lower surface, and while doing so, the rear and both lateral edge portions of the film are gathered together tightly underneath the tray.

Thereafter, the tray is transported forwardly by the rotation of a conveyor belt and is thereby transferred from the rear folding member to the front folding member. In the course of this transfer, the film abuts against the front folding member underneath the tray, and the film is also folded from the front side thereof, whereby the portions of the film folded from the right and left sides are overlaid on the portion of the film folded from the rear side, and the portion of the film folded from the front side is further laid thereon, thus forming a fold portion underneath the tray. Then, the rear folding member is retracted, and the right and left folding members are opened or separated from each other in response to the retraction of the rear folding member.

In the above-described wrapping film folding operation, when the rear folding member enters the space underneath the tray in such a manner as to contact the undersurface of the tray, it is easy for the rear folding member to collide with the rear edge of the undersurface of the tray at the beginning of this entry. In the case of wrapping a soft or flexible tray particularly, the above collision may cause the tray to be deformed so as to crush soft contents thereof, which leads to a deterioration in the value of commodities.

For this reason, it is conventional practice to allow the rear folding member to abut against the mounts at a position spaced slightly downwards from the undersurface of the tray on the mounts so as to prevent the aforementioned collision. In consequence, the right and left folding members which are positioned below the rear folding member are further separated from the undersurface of the tray. Accordingly, when the tray is wrapped while being gradullay transferred to the rear folding member from the rear end of its undersurface, the mounts are tilted by the right and left folding members to a substantial degree at both lateral sides of the undersurface of the tray, resulting in a relatively large space occurring between the tilted mounts and the undersurface of the tray, so that the tray is supported only by the rear folding member and the front mounts which are not tilted. Accordingly, during a folding operation, the tray easily oscillates laterally and may slide into the rear folding member and slant in a very unstable state.

In view of the above, the right and left folding members may be positioned above the rear folding member, and the tray may be placed on the right and left folding members when being folded in a piece of wrapping film. However, it is necessary when doing so to move the right and left folding members so as to enter the film area prior to the rear folding member. It is therefore very difficult to appropriately set the timing relationship between the rear folding member and the right and left folding members from the viewpoint of the folding procedure according to which these folding members effect their respective folding operations underneath the tray. Accordingly, it is desired that the conventional structures of the rear folding member and the right and left folding members should be improved.

SUMMARY OF THE INVENTION

It is an object of the present invention to provide a wrapping machine which has no risk of the rear folding member colliding with the rear edge of the undersurface of an object to be wrapped and has no possibility of the object oscillating laterally of sliding into the rear folding member so as to slant even if the mounts for mounting the object are tilted during a folding operation, and also provide a method of folding wrapping film in such a wrapping machine.

It is another object of the present invention to provide a wrapping machine which elimitates the risk of a tray being deformed to crush soft contents thereof when wrapped with a piece of wrapping film even if the tray is flexible or has a relatively large height, and also provide a method of folding wrapping film in such a wrapping machine.

To these ends, the present invention provides a wrapping machine comprising: front and rear folding members movable relative to each other in the longitudinal direction of the machine; a pair of lateral folding members respectively positioned on both lateral sides of the rear folding member and supported so as to be pivotal laterally, the lateral folding members being opened and closed with respect to each other in response to the longitudinal movement of the rear folding member; a folding area defined between the front and rear folding members and the pair of lateral folding members, in which folding area the edge portions of a piece of wrapping film are gathered together tightly underneath an object to be wrapped in a state wherein all of the folding members are in close proximity with each other; and a pair of mounting members positioned above the pair of lateral folding members, respectively, and entering the space underneath the object before all of the folding members enter the space underneath the object so as to fold the piece of wrapping film.

These and other objects of the present invention will be apparent from the following description of the preferred embodiment thereof and will be stated clearly in the appended claims. Many advantages of the present invention which are not mentioned in this specification will occur to those skilled in the art when carrying out the present invention.

DETAILED DESCRIPTION OF THE PREFERRED EMBODIMENT

A wrapping machine equipped with a wrapping film folding means in accordance with one embodiment of the present invention will be described hereinunder with reference to the accompanying drawings.

Figure 1:
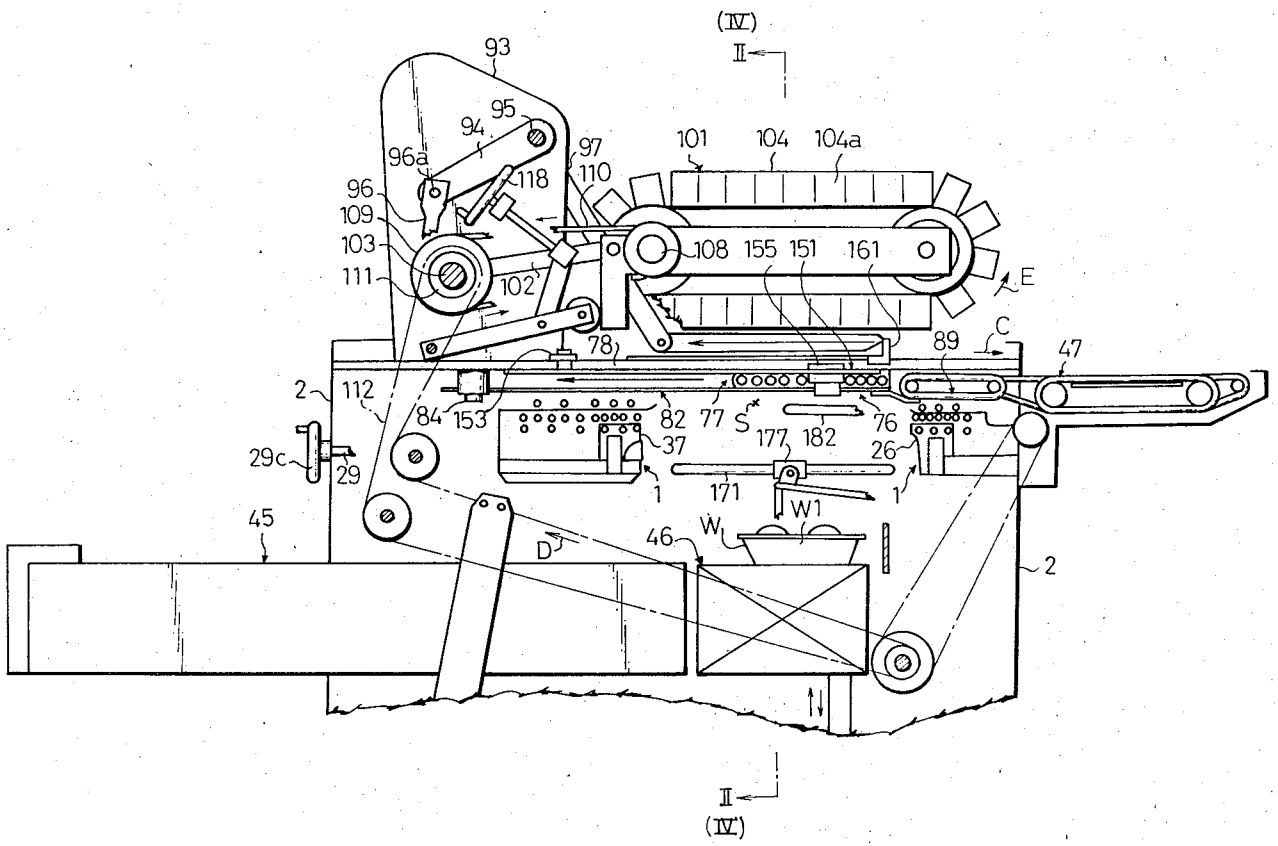
FIG. 1 is a schematic sectional side elevational view of a vegetable and fruit wrapping machine quipped with a wrapping film folding means in accordance with one embodiment of the present invention.
Figure 2:
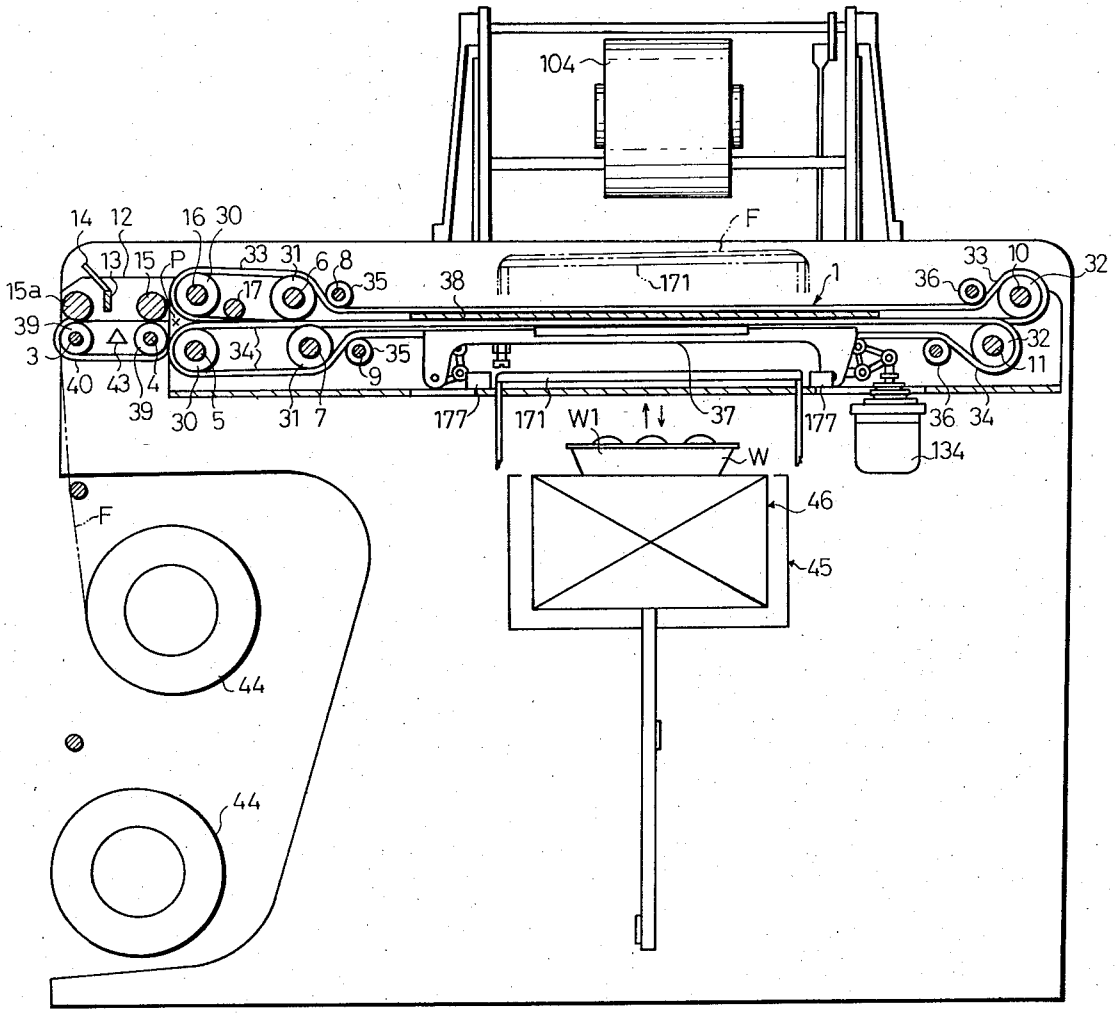
FIG. 2 is a schematic sectional view of the wrapping machine taken along the line II—II of FIG. 1.
Figure 3:
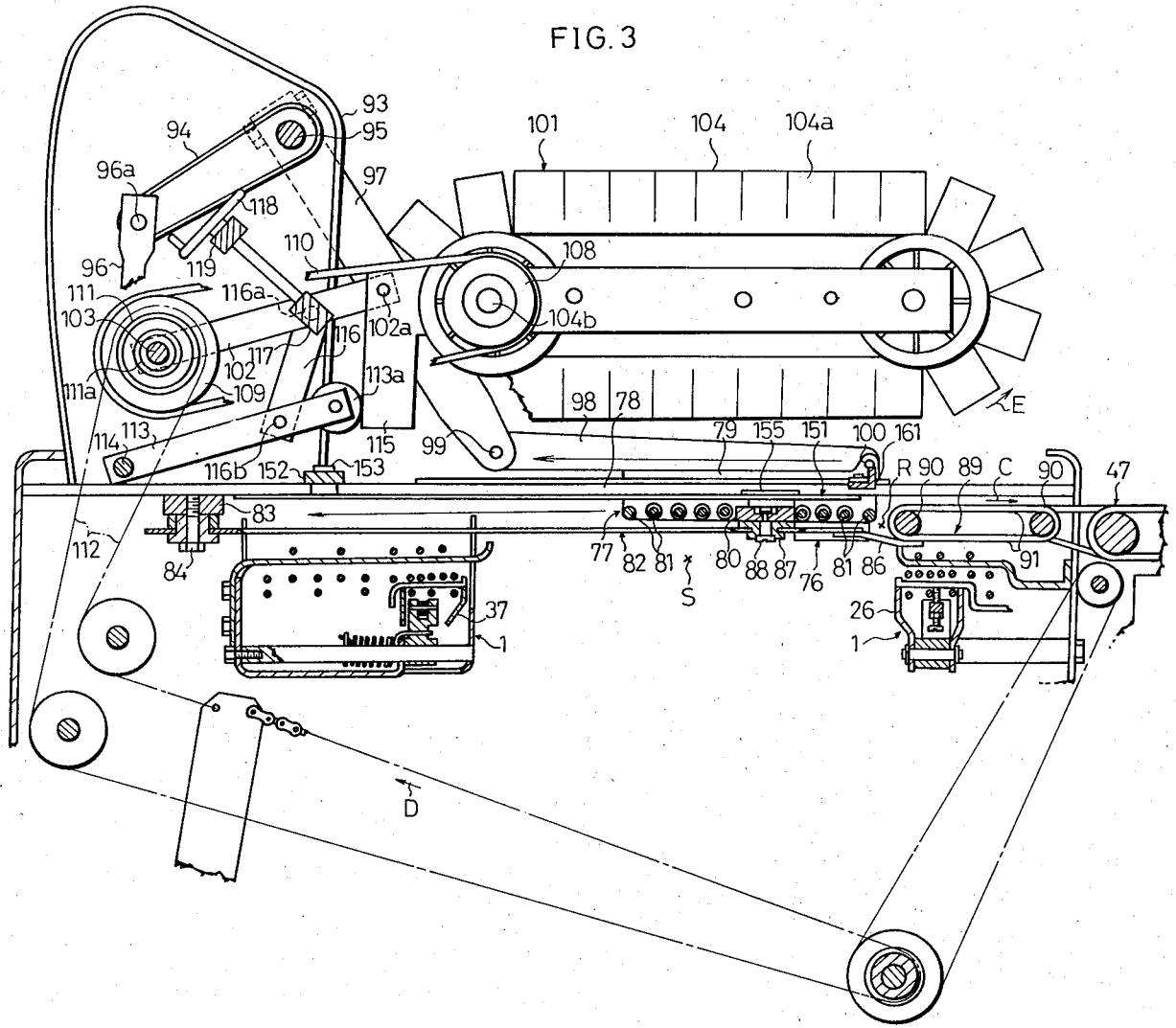
FIG. 3 is a schematic enlarged sectional side elevational view of the film folding means and the film transporting means of the wrapping machine.
Figure 4:
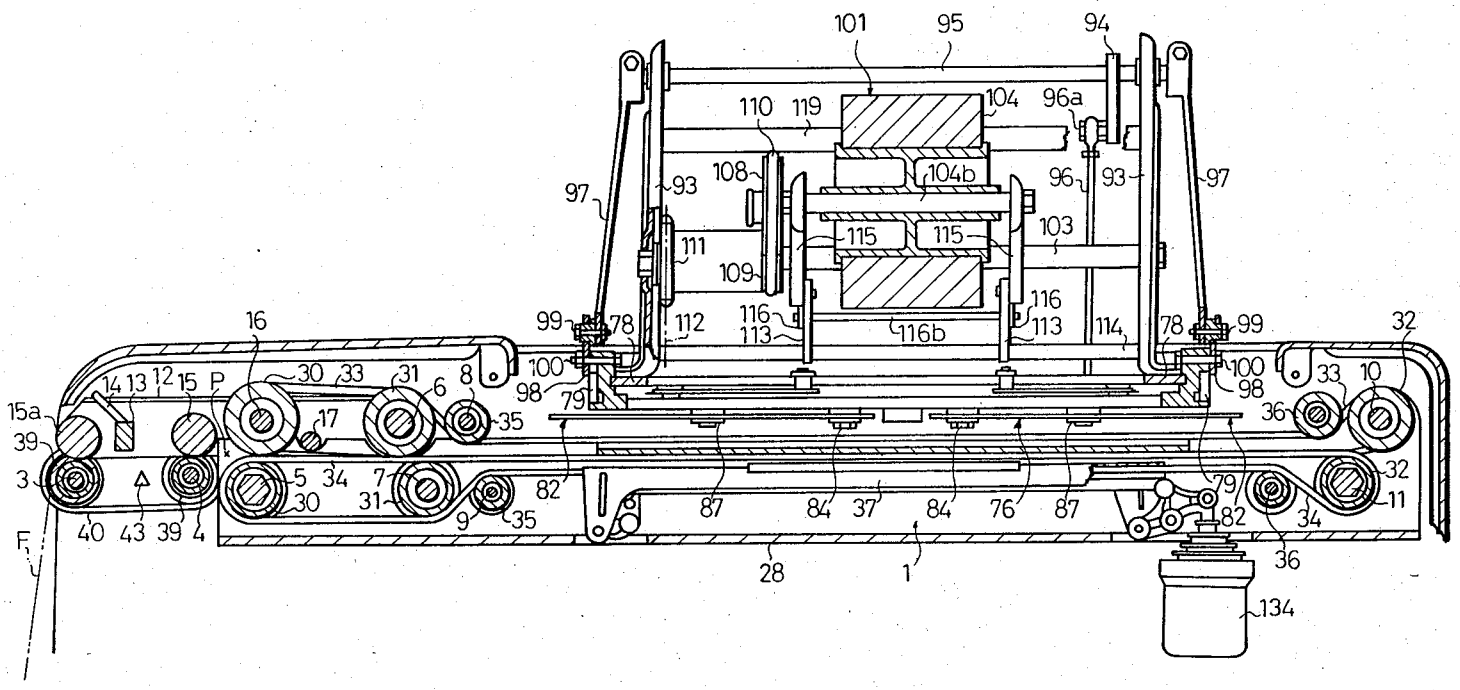
FIG. 4 is a schematic enlarged sectional view of the wrapping machine taken along the line IV—IV of FIG. 1, which shows the film folding means and the film transporting means.
Figure 5:
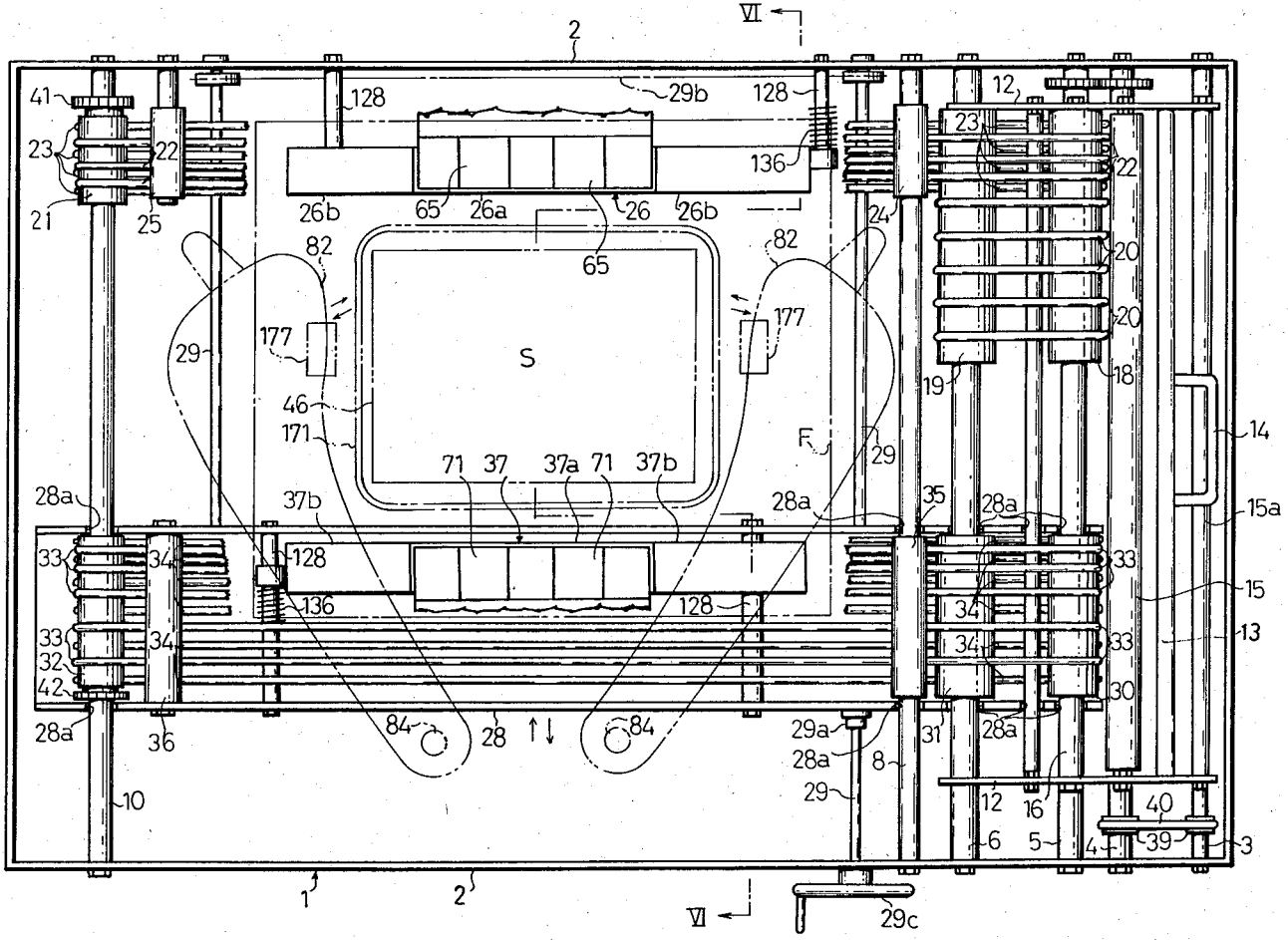
FIG. 5 is a schematic enlarged plan view of the film transporting means.

FIGS. 1 to 6 show a wrapping film transporting means 1 installed in the upper portion of the machine frame. As shown in FIGS. 2, 4 and 5, a pair of parallel outer and inner roller shafts 3, 4 are rotatably stretched between one end of a front fixed frame 2 and one end of a rear fixed frame 2. Next to the shaft 4, a shaft 5, a pair of upper and lower shafts 6, 7 and a pair of upper and lower shafts 8, 9 are fixedly stretched between both the frames 2. A pair of upper and lower shafts 10, 11 are fixedly stretched between the other end of the front fixed frame 2 and the other end of the rear fixed frame 2. The reference numeral 12 denotes a pair of pivotal frames vertically pivotally supported at the front and rear ends, respectively, of the shaft 6. The frames 12 extend from the shaft 6 as far as the upper side of the roller shaft 3. A support frame 13 with a grip 14 is fixedly stretched between the respective distal end portions of both the pivotal frames 12. A pair of roller shafts 15, 17 are rotatably stretched between the frames 12 and at the side thereof which is closer to the proximal ends thereof than the support frame 13, together with a shaft 16 which is fixedly stretched adjacent to the roller shafts 15, 17. Further, a vertically movable roller shaft **15*a* is stretched between the frames 12 and at the side thereof which is closer to the distal ends thereof than the support frame 13**.

Figure 6:
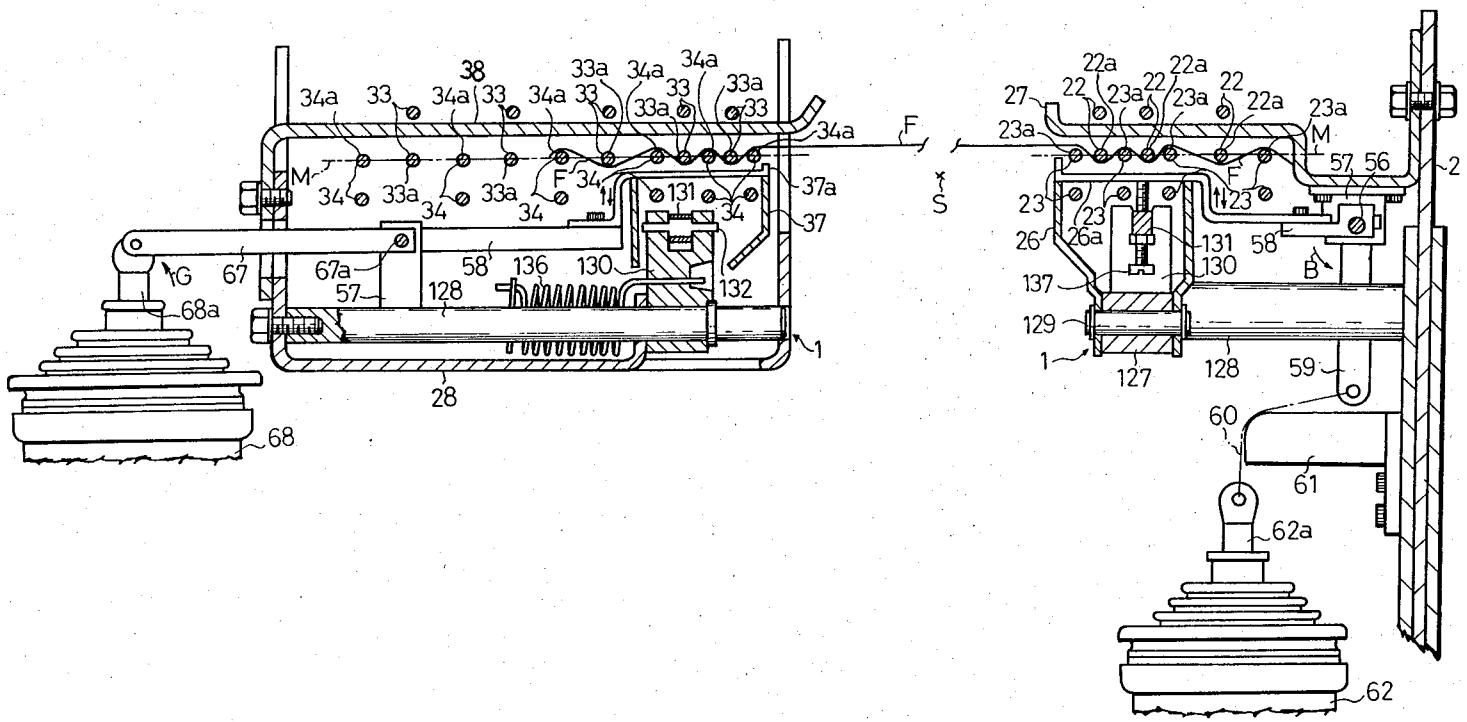
FIG. 6. is a schematic enlarged sectional view taken along the line VI—VI of FIG. 5.

In FIG. 5, the reference numeral 18 denotes a pair of upper and lower rollers rotatably supported by the respective front end portions of the pair of upper and lower shafts 16, 5, while the numeral 19 denotes a pair of upper and lower rollers rotatably supported by the respective front end portions of the pair of upper and lower shafts 6, 7. Five endless round belts 20 are stretched between the respective rear portions of the upper rollers 18, 19, and another set of five endless round belts 20 are stretched between the lower rollers 18, 19 so that the upper and lower belts 20 face each other, respectively. A pair of upper and lower rollers 21 are rotatably supported by the respective front end portions of the pair of upper and lower shafts 10, 11. Three endless round belts 22 are stretched between the respective front portions of the upper rollers 21, 18 through the upper roller 19. Four endless round belts 23 are stretched between the respective front portions of the lower rollers 21, 18 through the lower roller 19. As shown in FIG. 6, the lower running portion **22*a* of each of the upper round belts 22 is disposed between the respective upper running portions 23*a* of each pair of adjacent lower round belts 23 so that the running portions 22*a*, 23*a* are alternately disposed such as to constitute a seven-belt row M. The reference numeral 24 denotes a pair of upper and lower rollers rotatably supported by the respective front end portions of the pair of upper and lower shafts 8, 9, while the numeral 25 denotes a pair of upper and lower rollers rotatably supported by the fixed frames 2 at the inner side of the rollers 21. The rollers 24, 25 respectively tense the upper and lower round belts 22, 23. It is to be noted that the upper round belts 20, 22 are also tensed by the roller shaft 17**.

A tubular front pressing member 26 is vertically movably supported by the front fixed frame 2. As shown in FIG. 6, the respective lower running portions of the inner three round belts 23 among the lower round belts 23 are inserted into the front pressing member 26, the pressing portions **26*a*, 26*b* of the front pressing member 26 being interposed between the upper and lower running portions of the lower round belts 23. It is to be noted that the pressing portions 26*a*, 26*b* correspond to the inner five belt running portions in the belt row M. The numeral 27 denotes a pressure-receiving plate which extends from the fixed frame 2 so as to correspond to the pressing member 26. The plate 27 is, as shown in FIG. 6, interposed between the upper and lower running portions of the upper round belts 22**.

A movable frame 28 is fitted on the lower shafts 5, 7, 9 and 11 so as to be movable axially of these shafts. The frame 28 has internal thread portions **29*a* respectively secured to the right and left ends thereof. Externally threaded rods 29 are respectively screwed with the internal thread portions 29*a* and are supported by the fixed frames 2, the rods 29 being interlocked with each other by a chain 29*b*. A handle 29*c* is secured to the end of one of the rods 29 which projects out from the rear fixed frame 2. Thus, the movable frame 28 can be moved for adjustment by turning the handle 29*c*. It is to be noted that the upper shafts 16, 17, 6, 8 and 10 can engage with respective notches 28*a* formed in the upper edge portions of the movable frame 28**.

A pair of upper and lower rollers 30 are respectively supported by the pair of upper and lower shafts 16, 5 such as to be rotatable and movable along the axes of these shafts so that the rollers 30 can be positioned within the movable frame 28. A pair of upper and lower rollers 31 are supported by the pair of upper and lower shafts 6, 7 in a manner similar to that of the rollers 30. Similarly, a pair of upper and lower rollers 32 are respectively supported by the pair of upper and lower shafts 10, 11. These rollers 30, 31 and 32 are pushed by the movable frame 28 when moved for adjustment and therefore moved toghether with the movable frame 28 along the axes of the corresponding shafts.

The reference numeral 33 denotes five endless round belts stretched between the upper rollers 30, 32 through the upper roller 31, while the numeral 34 denotes six endless round belts stretched between the lower rollers 30, 32 through the lower roller 31. As shown in FIG. 6, the lower running portion **33*a* of each of the upper round belts 33 is interposed between the upper running portions 34*a* of each pair of adjacent lower round belts 34, so that the running portions 33*a*, 34*a* are alternately disposed to constitute an eleven-belt row M. A pair of upper and lower rollers 35 are supported by the pair of upper and lower shafts 8, 9 so as to be rotatable and movable along the axes of the shafts 8, 9. The rollers 35 are axially moved in response to the movement of the movable frame 28 for adjustment. Thus, the round belts 33, 34 are tensed by the rollers 35, together with a pair of upper and lower rollers 36 which are rotatably supported by the movable frame 28 and at the inner side of the rollers 32. It is to be noted that the upper round belts 33 are also tensed by the roller shaft 17**.

The reference numeral 37 denotes a tubular rear pressing member vertically movably supported by the movable frame 28, while the numeral 38 denotes a pressure-receiving plate which extends from the upper portion of the movable frame 28 so as to correspond to the rear pressing member 37. The positional relationship between the rear pressing member 37 and the pressure-receiving plate 38 on one hand and the upper and lower round belts 33, 34 on the other is the same as in the case of the front pressing member 26.

As shown in FIG. 5, a pair of pulleys 39 are supported by the respective rear end portions of the roller shafts 3, 4. An endless round belt 40 is stretched between the pulleys 39. In FIG. 5, the reference numeral 41 denotes gears respectively secured to the upper and lower rollers 21, while the numeral 42 denotes gears respectively secured to the upper and lower rollers 32 and axially movable together with the rollers 32. The driving rotational force from the lower shaft 11 is transmitted to the gears 41, 42 and is then transmitted to various portions through the rollers 21, 32, the round belts 22, 23, 33, 34 and so force. In FIGS. 2 and 4, the reference numeral 43 denotes a saw blade for forming perforations which is provided between the roller shafts 3, 4 stretched between one end of each of the fixed frame 2.

The following is a description of an operation in which wrapping film F is set on the thus arranged wrapping film transporting means 1 from one of the pair of upper and lower wind-up rolls 44 provided at one lateral end of the machine frame. In this case, the position of the movable frame 28 is adjusted in advance by moving the frame 28 in accordance with the width of the film F by turning the handle **29*c***.

The operator holds the grip 14 provided at one lateral end of the machine frame and raises it upwards as shown in FIGS. 2 and 4. In consequence, the pivotal frame 12 pivots upwards about the shaft 6, and the upper rollers 18, 30 and the lower rollers 18, 30 are thereby separated from each other, thus opening a film supply port P. In this state, the leading end of the wrapping film F unwound from the wind-up roll 44 is led to the supply port P through the roller shafts 3, 4 and placed on the lower round belts 20, 23 and 34.

Next, the pivotal frame 12 is pivoted downwards so as to return to its previous position so that the upper rollers 18, 30 and the lower rollers 18, 30 come close to each other, thereby closing the film supply port P. In consequence, as shown in FIG. 6, both lateral edges of the film F are respectively clamped by the belt rows M constituted by the lower running portions **22*a*, 33*a* of the upper round belts 22, 23 and the upper running portions 23*a*, 34*a* of the lower round belts 23, 34 in such a manner that the laternal edges of the film F are alternately passed over the respective running portions, that is, each of the lateral edges of the film F is passed over the upper side of the inner first running portion 23*a* (34*a*), the lower side of the second running portion 22*a* (33*a*), the upper side of the third running portion 23*a* (34*a*) and so forth. Thus, both lateral edges of the film F are clamped in a vertically meandering condition. In this set state, the wrapping film F is stretched over the wrapping area S by driving the transporting means 1**.

A wrapping film pressing means will next be described in detail with reference to FIGS. 1 to 12. The aforementioned front pressing member 26 is, as shown in FIG. 5, constituted by a center pressing portion **26*a* and side pressing portions 26*b* on the right and left sides of the center pressing portion 26*a*. More specifically, the side pressing portions 26*b* are, as shown in FIG. 9**, integrally connected together by a connecting portion 26c, and the center pressing portion 26a is mounted on a recess 26d formed in the upper surface of the connecting portion 26c.

Figure 9:
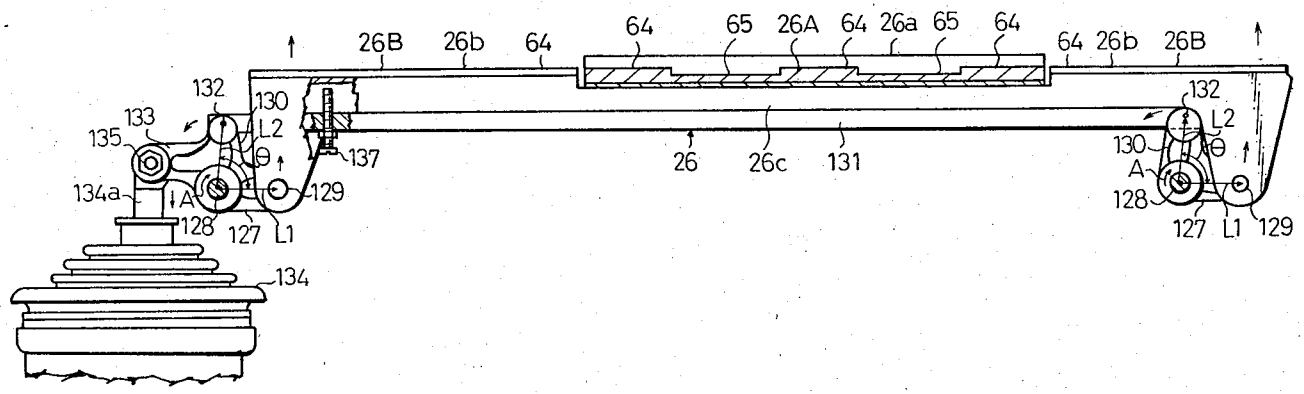
FIG. 9 is a partially cutaway front elevational view of the front pressing member.
Figure 10:
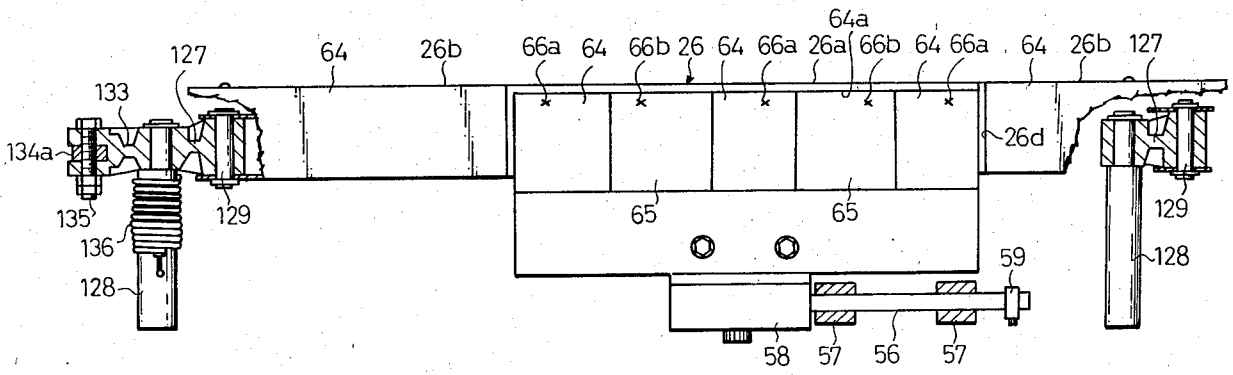
FIG. 10 is a partially cutaway plan view of the front pressing member.

A mechanism for vertically moving the side pressing portions 26b is shown in FIGS. 9 and 10. A pair of support rods 127 extend horizontally from respective fixed shafts 128 in the same direction and are pivotally supported by the shafts 128, the shafts 128 being respectively supported at the front and rear end portions of the front fixed frame 2. Between the respective distal ends of the support rods 127 are pivotally supported the side pressing portions 26b by respective shafts 129, the distance L1 between the centers of each pair of shafts 128, 129 being set such as to be equal to each other. The reference numeral 130 denotes a pair of interlocking rods each of which extends upwards from each of the fixed shafts 128 and is integrated with the corresponding support rod 127. A connecting rod 131 is pivotally supported between the respective distal ends of the interlocking rods 130 through a shaft 132, the distance L2 between the centers of each pair of shafts 128, 132 being set such as to be equal to each other. Further, the angle $\theta$ between the support rod 127 and the interlocking rod 130 on the center line of the fixed shaft 128 at each of the front and rear ends of the front fixed frame 2 is set at the same value. The numeral 133 denotes a control rod which is intergrated with one of the support rods 127 (referred to as the "first support rod 127", hereinafter) and extends horizontally therefrom with the fixed shaft 128 positioned in its center. The distal end portion of the control rod 133 is pivotally connected through a shaft 135 to a movable rod 134a of a solenoid 134 secured to the machine frame. The numeral 136 denotes a spring 136 which is wound around one of the fixed shafts 128 and constantly urges the support rods 127, the interlocking rods 130 and the control rod 133 so that they pivot in the direction of the arrow A. Further, a stopper bolt 137 is screwed into the connecting rod 131.

Figure 7:
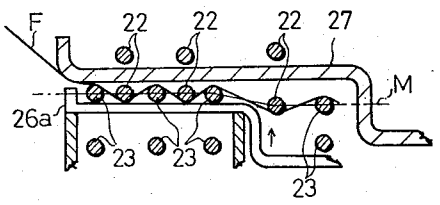

When the solenoid 134 is turned ON and the movable rod 134a is thereby moved downwards, the first support rod 127 interlocked with the control rod 133 is pivoted about the fixed shaft 128 in the direction opposite to the direction of the arrow A against the urging force of the spring 136. Further, the connecting rod 131 is pulled obliquely downwards by the interlocking rod 130 which pivots about the shaft 128 in response to the pivotal movement of the support rod 127. The motion of the connecting rod 131 causes the other interlocking rod 130 to pivot about the fixed shaft 128 in the direction opposite to the direction of the arrow A, so that the second support rod 127 is also pivoted about the shaft 128 in the direction opposite to the arrow A. When both the support rods 127 are simultaneously pivoted in the direction opposite to the arrow A, the side pressing portions 26b as a whole are uniformly raised. In consequence, as shown in FIG. 7, the inner five belt portions in the belt row M are reliably clamped between the side pressing portion 26b and the pressure-receiving plate 27. It is to be noted that the upward movement of the side pressing portion 26b is effected simultaneously with the upward movement of the center pressing portion 26a.

When the solenoid 134 is turned OFF and the movable rod 134a is consequently moved upwardly by means of the urging force of the spring 136, the side pressing portions 26b as a whole are uniformly lowered. The lowered position of the side pressing portions 26b can be adjusted by means of the stopper bolt 137.

FIGS. 6 and 10 show in combination a mechansim for vertically moving the center pressing portion 26a. The reference numeral 56 denotes a pivotal shaft which is pivotally supported by a pair of brackets 57 secured to the lower surface of the pressure-receiving plate 27, while the numeral 58 denotes a mounting member which is secured to one end of the shaft 56, and the center pressing portion 26a is secured to the mounting member 58. An interlocking rod 59 is secured to the other end of the movable shaft 56, the rod 59 extending downwards. The reference numeral 60 denotes a chain 60 having one end thereof connected to the lower end portion of the interlocking rod 59. The chain 60 is guided downwards through a guide member 61 secured to the fixed frame 2 and has the other end thereof connected to a movable rod 62a of a solenoid 62. It is to be noted that the pivotal shaft 56 is urged so as to pivot in the direction of the arrow B.

When the solenoid 62 is turned ON and the movable rod 62a is thereby moved downwards, the chain 60 is pulled downwards, and the interlocking rod 59 is thereby pivoted in the direction opposite to the direction of the arrow B. This pivotal motion of the rod 59 causes the center pressing portion 26a to be pivoted about the pivotal shaft 56 in the direction opposite to the direction of the arrow B, whereby the inner five belt portions in the belt row M are reliably clamped between the center pressing portion 26a and the pressure-receiving plate 27. When the solenoid 62 is turned OFF and the pivotal shaft 56 is consequently pivoted in the direction of the arrow B, the center pressing portion 26a is pivoted about the pivotal shaft 56 in the direction of the arrow B so as to be remounted on the recess 26d formed between the side pressing portions 26b.

Figure 11:
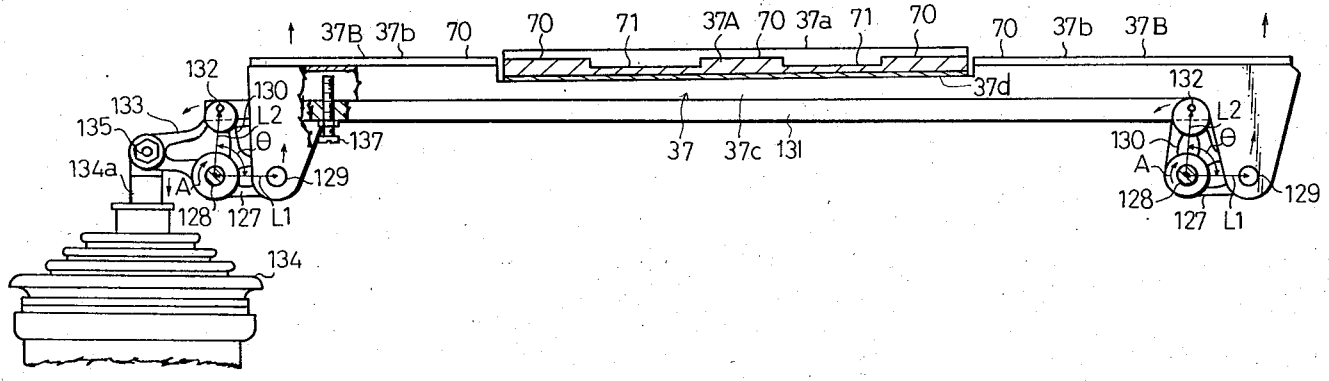
FIG. 11 is a partially cutaway front elevational view of the rear pressing member.
Figure 12:
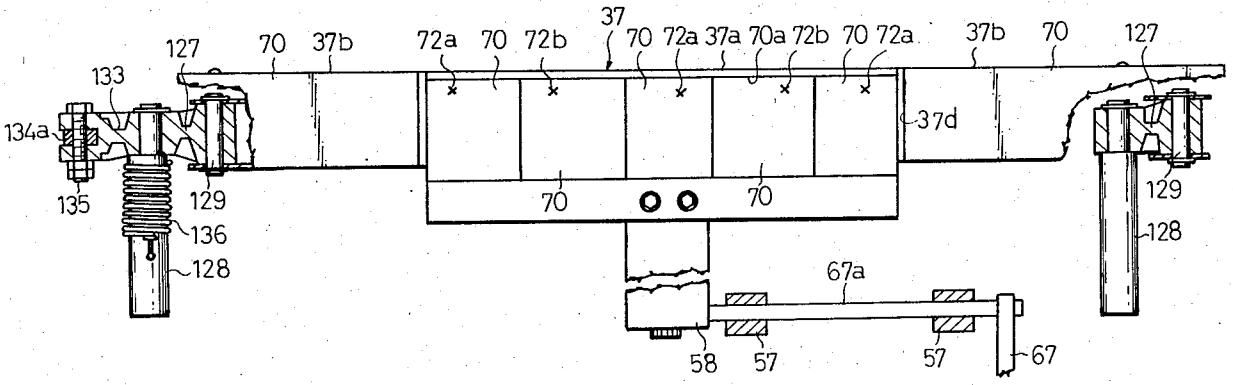
FIG. 12 is a partially cutaway plan view of the rear pressing member.

As shown in FIGS. 11 and 12, the rear pressing member 37 is also constituted by a center pressing portion 37a and a pair of side pressing portions 37b in a manner similar to that of the front pressing member 26. More specifically, the side pressing portions 37b are integrally connected by a connecting portion 37c, and the center pressing portion 37a is mounted on a recess 37d formed in the upper surface of the connecting portion 37c. However, the center pressing portion 37a of the rear pressing member 37 is vertically moved by a mechansim which is slightly different from that for the center pressing portion 26a of the front pressing member 26. Namely, as shown in FIGS. 6 and 12, the center pressing portion 37a is secured through a mounting member 58 to one end portion of a support shaft 67a supported by a pair of brackets 57. A lever rod 67 is secured to the other end portion of the support shaft 67a.

The other end portion of the lever rod 67 is pivotally connected to a movable rod 68a of a solenoid 68. The lever rod 67 is urged so as to pivot about the support shaft 67a in the direction of the arrow G. It is to be noted that the pressing action of the rear pressing member 37 is similar to that of the front pressing member 26.

Pieces of sponge material 26A, 26B, 37A and 37B are respectively attached to the center pressing portions 26a, 37a and the side pressing portions 26b, 37b of the front and rear pressing members 26, 37, the respective upper surface of these pieces of sponge material being adapted to serve as pressing surfaces 64, 70. As shown in FIGS. 9 to 12, recesses 65 are respectively formed at the right and left portions on the pressing surface 64 of the center pressing portion 26a, and recesses 71 at the right and left portions on the pressing surface 70 of the center pressing portion 37*a*. The recesses 65, 71 respectively define abutment portions 66*a*, 72*a* and gap portions 66*b*, 72*b* at the respective inner edges 64*a*, 70*a* of the pressing surfaces 64, 70, the abutment portions 66*a*, 72*a* contacting wrapping film F but the gap portions 66*b*, 72*b* not contacting the film F when it is clamped between the front and rear pressing members 26, 37 and the pressure-receiving plates 27, 38.

Figure 14:
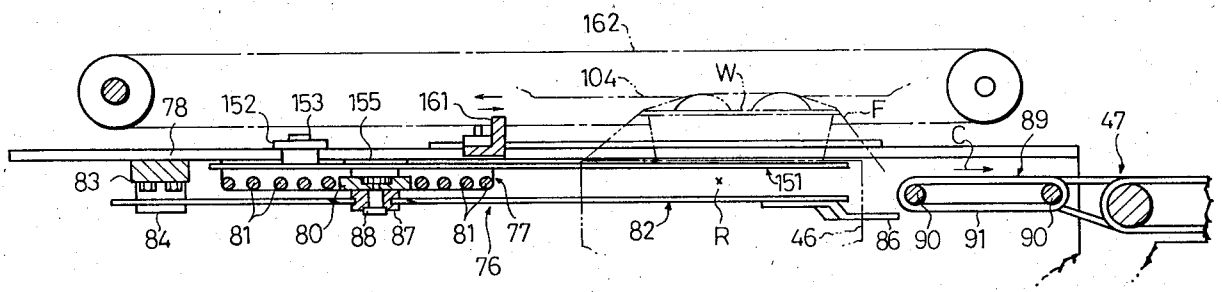
FIG. 14 is a schematic sectional side elevational view of the film folding means.
Figure 15:
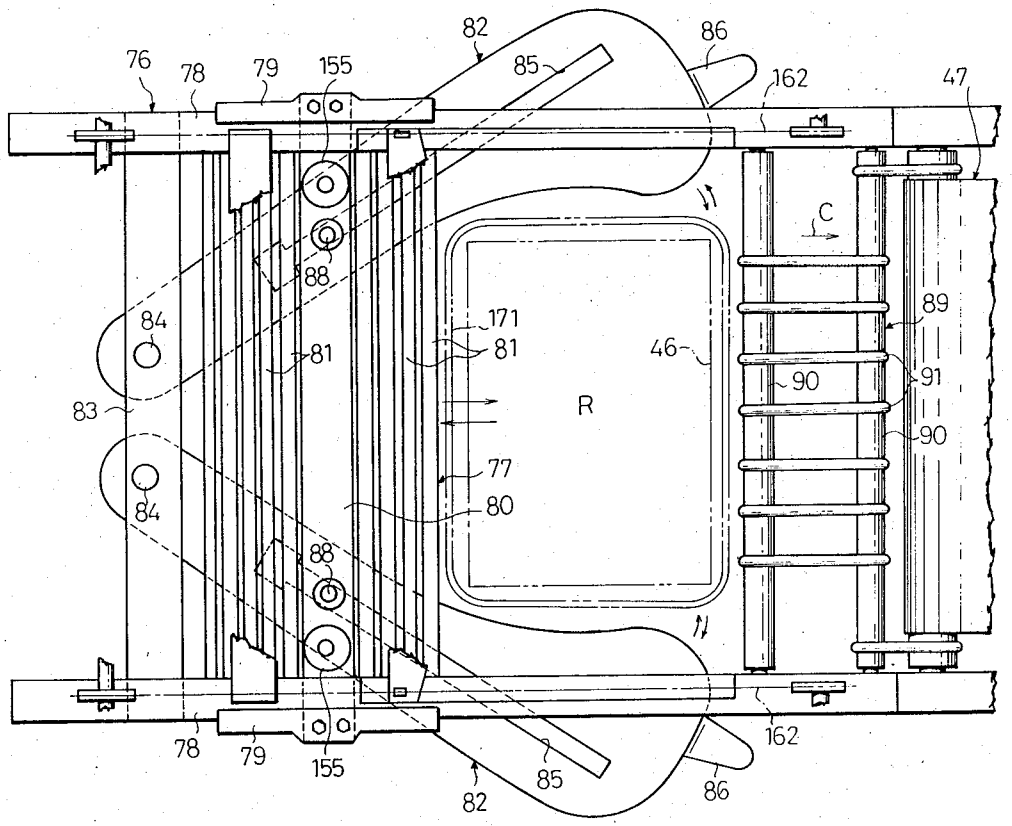
FIG. 15 is a partially cutaway plan view of the film folding means, which shows various folding members in the film folding means.
Figure 17:
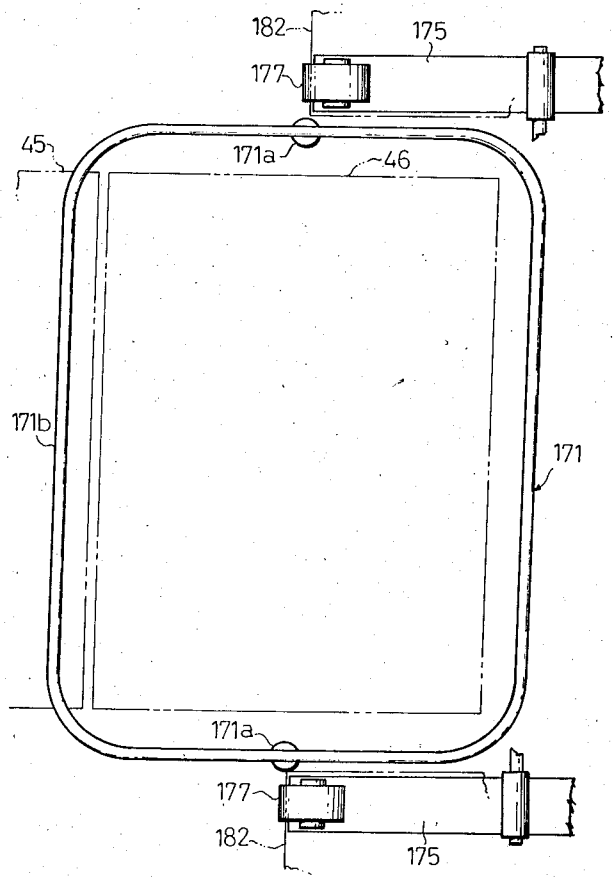
FIG. 17 is a schematic plan view of the push-up member and the right and left pressing members.

FIGS. 1, 3, 4, 13 to 15 and 22 to 24 show in combination a wrapping film folding means 76 installed above the film transporting means 1. As shown in FIG. 15, a rear folding member 77 includes sliders 79 respectively supported on rails 78 respectively disposed along the right and left ends of the upper portion of the machine base so that the sliderts 79 are movable along the longitudinal axes of the rails 78, the sliders 79 being connected together by a guide plate 80 and front and rear rollers 81. A pair of right and left folding members 82 are horizontally pivotally connected through respective shafts 84 to a support plate 83 stretched between the rails 78 and at the rear of the rear folding member 77. The right and left folding members 82 extend forwards from the shaft 84 while passing below the rear folding member 77. A guide groove 85 is longitudinally formed in each of the right and left folding members 82 so as to extend therethrough from one to the other surface thereof. An auxiliary folding plate 86 is screwed to the distal end of each folding member 82 so that the position thereof is adjustable. A guide piece 87 is pivotally supported through a shaft 88 at each of the right and left end positions on the lower surface of the guide plate 80 of the rear folding member 77. The guid pieces 87 are fitted into the respective guide grooves 85 of the right and left folding members 82.

A front folding member 89 includes a pair of rollers 90 which are stretched between the rails 79 and which are interlocked by means of a plurality of belts 91 which are rotated only in the direction of the arrow C.

As particularly shown in FIGS. 3 and 4, brackets 93 project upwardly from the respective rear end portions of the rails 78, and a lever 94 is secured to a support shaft 95 pivotally stretched between the respective upper portions of the brackets 93. The lever 94 is pivotally connected through a shaft 96*a* to an interlocking rod 96 which is vertically moved. A pair of levers 97 are respectively secured to both end portions of the support shaft 95 which project out from the corresponding brackets 93. A link 98 is pivotally connected to the distal end portion of each lever 97 through a shaft 99. Each link 98 is pivotally connected to the distal end portion of the corresponding slider 79 through a shaft 100.

Figure 22:
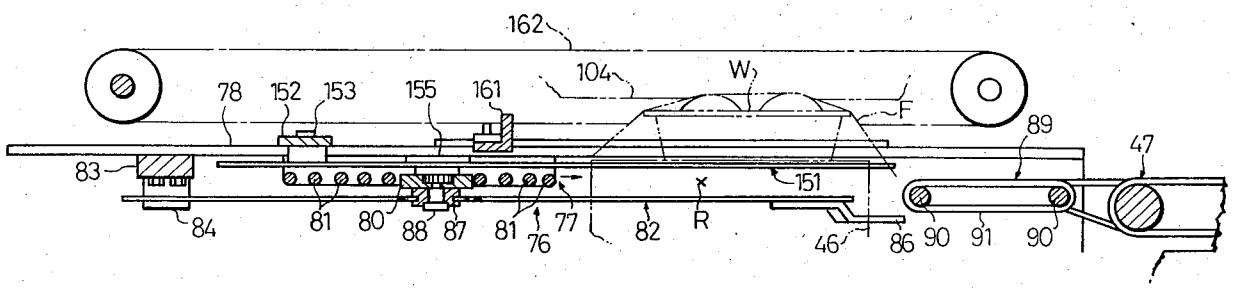
FIGS. 22 to 24 are schematic enlarged sectional side elevational views showing a film folding operation.

When the interlocking rod 96 is placed in its upper position, the rear folding member 77 is placed at its retracted position, and the right and left folding members 82 are in their open position, as shown in FIG. 15. When, in this state, the interlocking rod 96 is moved downwards, the rear folding member 77 is, as shown in FIG. 22, pushed by the levers 97 and the links 98 so as to advance, and the right and left folding members 82 are moved toward each other or closed by the action of the respective guide pieces 87 provided on the rear folding member 77 which are guided by the respective guide grooves 85 of the right and left folding members 82, whereby a folding area R is defined between the front, rear, right and left folding members 89, 77 and 82. As shown in FIG. 5, the folding area R corresponds to the wrapping area S of the film transporting means 1.

Figure 13:
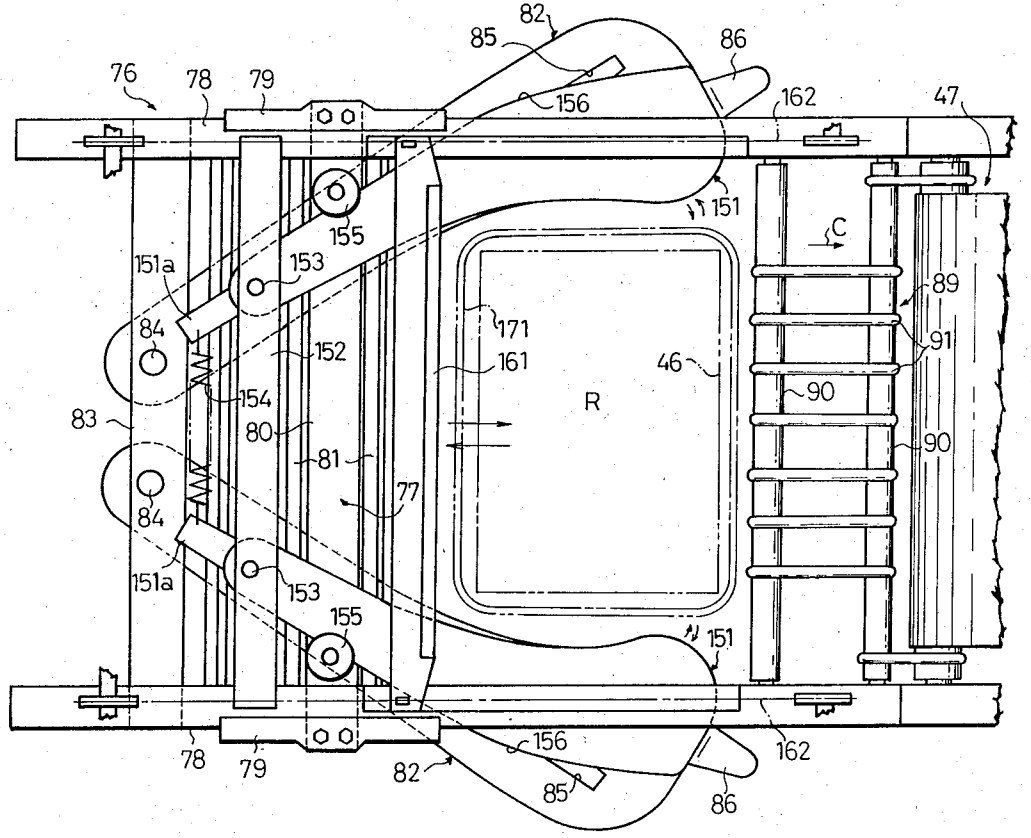
FIG. 13 is a schematic plan view of the film folding means.

Referring next to FIGS. 13 and 14, a pair of mounting members 151 are horizontally pivotally connected through respective shafts 153 to a support plate 152 which is stretched between the above-described right and left rails 78 and above the rear folding member 77. The mounting members 151 are disposed above the rear folding member 77 so as to correspond to the right and left folding members 82. The mounting members 151 are constantly urged so as to open or separate from each other by the action of a spring 154 connected between the respective proximal ends 151*a* of the members 151. Guide pieces 155 are respectively mounted on the right and left end portions of the guide plate 80 and are engaged with the respective outer guide edges 156 of the mounting members 151 so that the guide pieces 155 limit the degree of opening or separation between the mounting members 151 effected by the spring 154 in response to the longitudinal movement of the rear folding member 77.

A push-out member 161 is stretched between the rails 78 and above the mounting members 151 so that the member 161 is movable in the longitudinal direction of the rails 78. Both ends of the push-out member 161 are respectively connected to an endless chain 162 so that the member 161 is reciprocatively moved between the rear position of the rails 78 and a position near the front folding member 89 by the forward and backward rotation of the chain 162.

Referring to FIGS. 1 to 4 which show in combination a transporting means 101 for transporting objects to be wrapped W, a pair of support plates 102 are pivotally supported at both ends respectively of a support shaft 103 stretched between the respective lower portions of the brackets 93. The support plates 102 extend forwardly from the support shaft 103. A conveyor 104 with an endless belt 104*a* of sponge material is disposed between the respective front ends of the plates 102, and both lateral ends of the rear end portion of the conveyor 104 are pivotally supported by the respective front ends of the support plates 102 through a shaft 102*a*. The conveyor 104 is disposed so as to correspond to the wrapping area S of the film transporting means 1. A pair of guide levers 113 are pivotally supported at both ends of a support shaft 114 which is stretched between the brackets 93 and below the support shaft 103. Rollers 113*a* which are mounted on the respective distal end portions of the guide rods 113 abut respective guide plates 115 suspended from both lateral ends of the rear end portion of the conveyor 104.

A pair of interlocking links 116 are each pivotally connected between a first position on one support plate 102 and a second position on one guide rod 113 through shafts 116*a*, 116*b*, the first position being located between the support shaft 103 and the shaft 102*a*, and the second position being located between the support shaft 114 and the roller 113*a*. The upper right and left shafts 116*a* are connected together by a connecting rod 117. A handle 118 is screwed to a support rod 119 stretched between the respective upper portions of the brackets 93, the handle 118 being secured to the connecting rod 117.

When the handle 118 is turned so as to be moved vertically relative to the support rod 119, the support plates 102 are pivoted upwardly about the support shaft 103, and the guide rods 113 are pivoted upwardly about the support shaft 114 through the respective links 116.

Further, the conveyor 104 is moved substantially parallel in the upward direction with the rollers 113*a* of the guide rods 113 sliding on the guide plates 115 of the conveyor 104.

A belt pulley 108 is secured to a driving shaft 104*b* of the conveyor 104, and a belt pulley 109 is rotatably supported by the support shaft 103. A belt 110 is stretched between the belt pulleys 108, 109. A sprocket 111 is rotatably supported by the support shaft 103 so as to interlock with the belt pulley 109. The sprocket 111 is driven by a chain 112.

When the chain 112 is rotated in the direction of the arrow D, the belt 104*a* of the conveyor 104 is rotated in a delivery direction indicated by the arrow E through the sprocket 111, the belt pulley 109, the belt 110 and the belt pulley 108. However, since the sprocket 111 is supported by the support shaft 103 through a one-way clutch 111*a*, the rotation of the chain 112 is not transmitted to the sprocket 111; hence, the belt 104*a* of the conveyor 104 is not rotated backwardly.

Referring to FIGS. 1 and 2, a delivery means 46 is vertically moved between the inner end of a supply means 45 and the folding area R through the wrapping area S. The delivery means 46 has a plurality of mounts (not shown) which are tiltably urged. At the lowermost position, an object W is transferred from the supply means 45 and is mounted on the mounts.

As shown in FIGS. 1, 2, 5, 13 and 16 to 21, a push-up members 171 is connected through shafts 173*a* to the respective distal end portions of a pair of levers 173 secured to a pivotal shaft 172 at the right and left sides of the delivery means 46. The push-up member 171 is constituted by vertical rods 171*a* extending upwardly from the respective shafts 173*a*, and a frame 171*b* detachably connected between the respective upper end portions of the vertical rods 171*a*. A lever 174 is pivotally connected through a shaft 174*a* to an intermediate portion of each vertical rod 171*a*, thereby constituting a parallel crank mechanism.

A pair of lever plates 175 are pivotally supported through respective shafts 176*a* by the upper end portions of a pair of links 176 at the right and left sides of the frame 171*b*. A pair of right and left pressing members 177 are tiltably supported on the respective lever plates 175. A guide slot 178 is longitudinally formed in each link 176, and a guide piece 179 secured to each lever 174 is engaged with the guide slot 178.

A spring 180 is connected to each lever 173. The spring 180 constantly urges the lever 173 so as to tilt downwards. A spring 181 is connected to each lever plate 175. The spring 181 urges the lever plate 175 so as to tilt upwards.

A pair of pressure-receiving plates 182 are secured to the machine frame above the right and left pressing members 177 so as to face the respective members 177.

Figure 16:
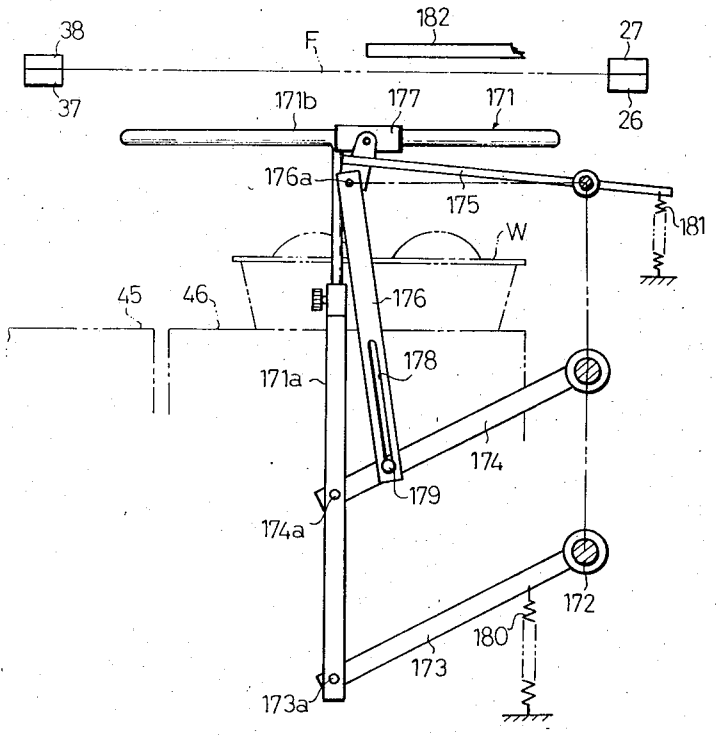
FIG. 16 is a schematic side elevational view of the push-up member and the right and left pressing members.

As shown in FIG. 16, when the levers 173 are titled downwardly by the urging forces of the corresponding springs 180, the vertical rods 171*a* of the push-up member 171 are moved downwards, and the frame 171*b* of the member 171 is also moved downwards. In response to the downward movement of the frame member 171*b*, the levers 174 are tilted downwards while pulling the links 176 downwardly, thus causing the lever plates 175 to tilt downwards against the urging forces of the springs 181. The right and left pressing members 177 are also moved downwardly and therefore separated from the corresponding pressure-receiving plates 182.

Figure 18:
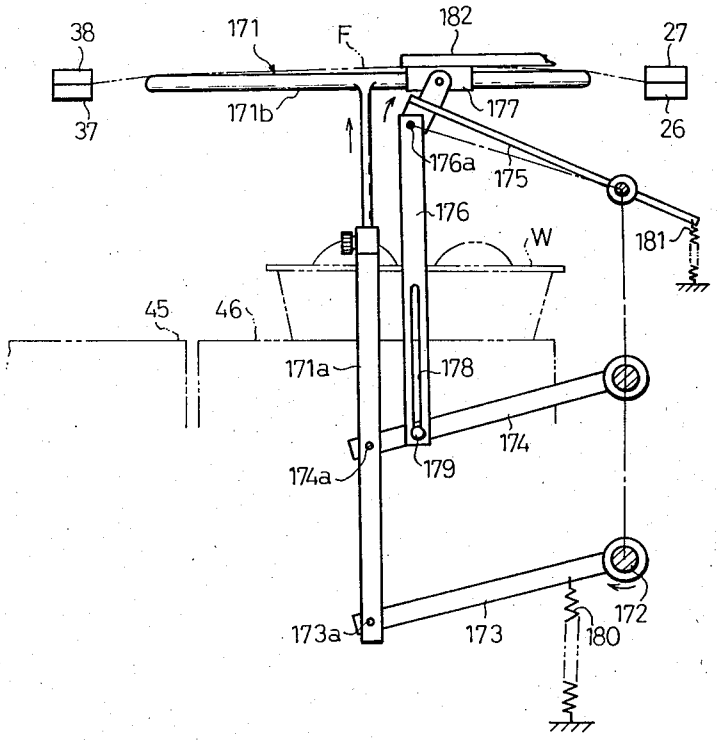

When, in this state, the levers 173 are tilted upwardly by the pivoting motion of the pivotal shaft 172 against the urging forces of the springs 180 as shown in FIG. 18, the vertical rods 171*a* of the push-up member 171 are moved upwardly, and the frame 171*b* is thereby moved upwardly toward the wrapping area S and the folding area R. In response to the upward movement of the frame 171*b*, the levers 174 are tilted upwardly. In consequence, the guide pieces 179 of the levers 174 move upwards along the respective guide slots 178 of the links 176. Together with the upward movement of the guide pieces 179, the lever plates 175 are tilted upwardly by the urging forces of the springs 181, thus causing the links 176 to be pulled up. When the frame 171*b* reaches a position near the pressure-receiving plates 182, the right and left pressing members 177 are pressed against the corresponding pressure-receiving plates 182 by the urging forces of the springs 181.

Figure 19:
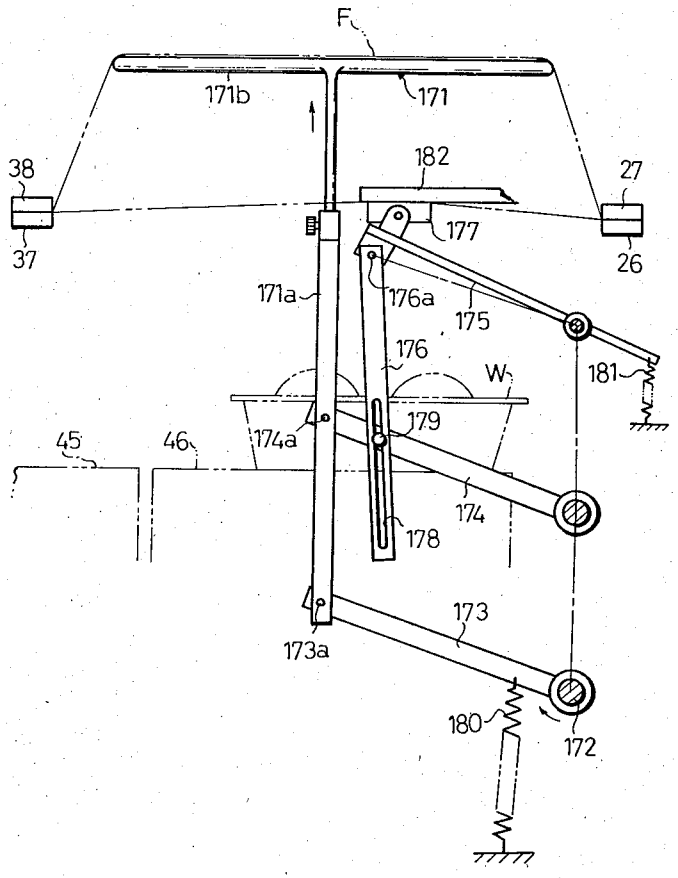
FIGS. 18 to 21 are schematic side elevational views showing the vertical motion of the push-up member and the right and left pressing members and the positional relationship between these members and the delivery means.
Figure 21:
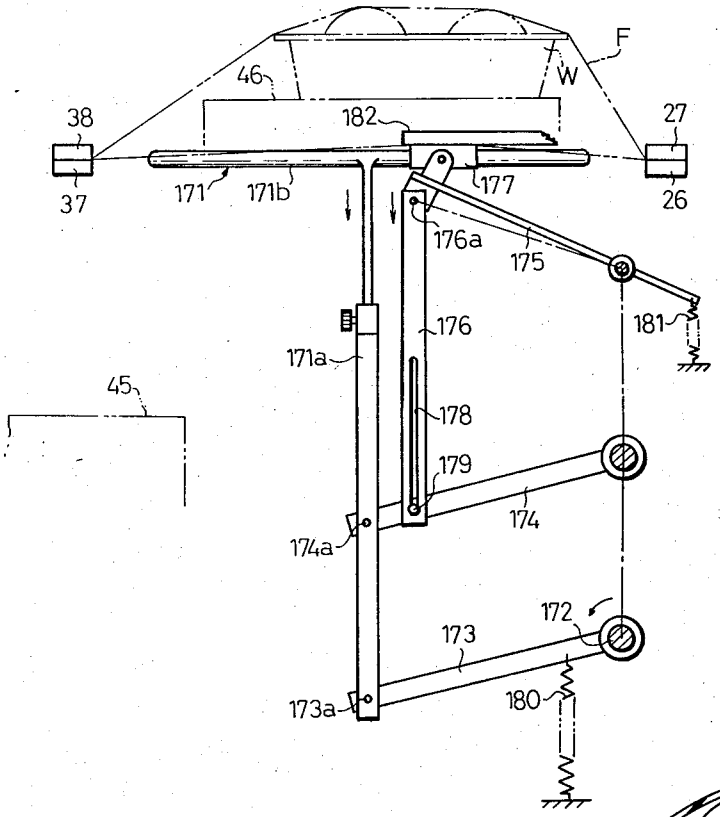

When the levers 173 are tilted upwardly with the right and left pressing members 177 being pressed against the pressure-receiving plates 182 as shown in FIG. 19, the frame 171*b* is further moved upwardly, and the respective guide pieces 179 of the levers 174 move upwards along the respective guide slots 178 of the links 176. When these guide pieces 179 abut against the respective upper ends of the guide slots 178, the tilting motiton of the levers 174 is stopped. Reversely, when the levers 173 are tilted downwardly, the vertical rods 171*a* and the frame 171*b* of the push-up member 171 are moved downwardly, and the levers 174 are tilted downwardly with the guide pieces 179 moved downwardly along the respective guide slots 178 of the links 176. As shown in FIG. 21, when the links 176 are pulled down in a state wherein the guide pieces 179 are retained by the respective lower ends of the guide slots 178, the lever plates 175 are tilted downwardly by the urging forces of the springs 181, thus causing the right and left pressing members 177 to move downwardly so as to separated from the corresponding pressure-receiving plates 182.

The following is a brief description of an actual wrapping operation.

When an object to be wrapped W (a tray W1 with its contents) is mounted on the supply means 45, the object W is transported by the supply means 45 and transferred to the delivery means 46 which has already been moved downwardly. At this time, the push-up member 171 has already been moved to its lowermost position, and the rear folding member 77 is retracted by the upward movement of the interlocking rod 96.

When the film transporting means 1 is driven in synchronism with this feed operation, the leading end of the wrapping film F positioned at the supply port P is transported toward the wrapping area S in the center of the transporting means 1. In the course of this transportation, lateral perforations are formed in the wrapping film F at predetermined regular lengths by the saw blade 43. Further, the roller shaft 4 is momentarily braked, and the wrapping film F which is clamped between the shafts 15, 4 is thereby pulled so as to be cut along the perforations. The film F is then transported to a position above the wrapping area S, as shown in FIG. 5.

Figure 8:
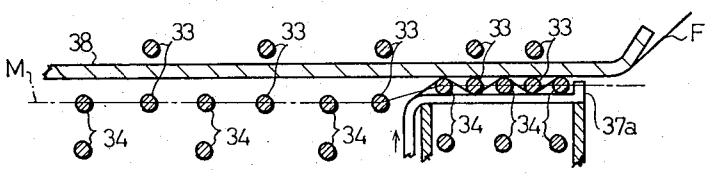
FIGS. 7 and 8 are fragmentary sectional views showing the way in which the front and rear pressing members clamp wrapping film.

The wrapping film F above the wrapping area S is clamped between the front and rear pressing members 26, 37 and the pressure-receiving plates 27, 38 as the result of the upward movement of the pressing members 26, 37, as shown in FIGS. 7 and 8.

When, in this film set state, the push-up member 171 is moved upwardly, the right and left pressing members 177 abut against the corresponding pressure-receiving plates 182 when the frame 171*b* of the push-up member 171 reaches the film F, as shown in FIG. 18, whereby the right and left edges of the film F are also clamped. Thereafter, the film F is pushed upwardly by the frame 171*b* so as to be tensely stretched, as shown in FIGS. 2 and 19.

Since not only the front and rear edges but also the right and left edges of the film F are clamped, when the film F is pushed up by the frame 171*b* of the push-up member 171, the film F is uniformly stretched without any wrinkle. Since the gap portions 66*b*, 72*b* which are not contacted by the film F are particularly provided at the inner edges 64*a*, 70*a* of the pressing surfaces 64, 70 of the front and rear pressing members 26, 37, the degree of stretching of the film F is lowered near the gap portions 66*b*, 72*b*, whereby the degree of stretching of the entire film F is lessened.

Accordingly, it is possible to wrap the object W with the film F at an appropriate degree of stretching of the film F simply by changing or modifying the gap portions 66*b*, 72*b* in accordance with the flexibility and height of the tray W1. There is therefore no risk of the tray W1 being deformed to crush soft contents thereof when wrapped even if the tray W1 is flexible or has a relatively large height. Further, the tray W1 is usually mounted on the delivery means 46 so that both longitudinal ends of the tray W1 respectively face the front and rear pressing members 26, 37. Accordingly, if the pressing force of the film F is applied to the longitudinal ends of the tray W1, the tray W1 is very easily deformed. For this reason, the gap portions 66*b*, 72*b* are provided in the respective center pressing portions 26*a*, 37*a* of the front and rear pressing members 26, 37, thereby preventing any deformation of the tray W1.

Figure 20:
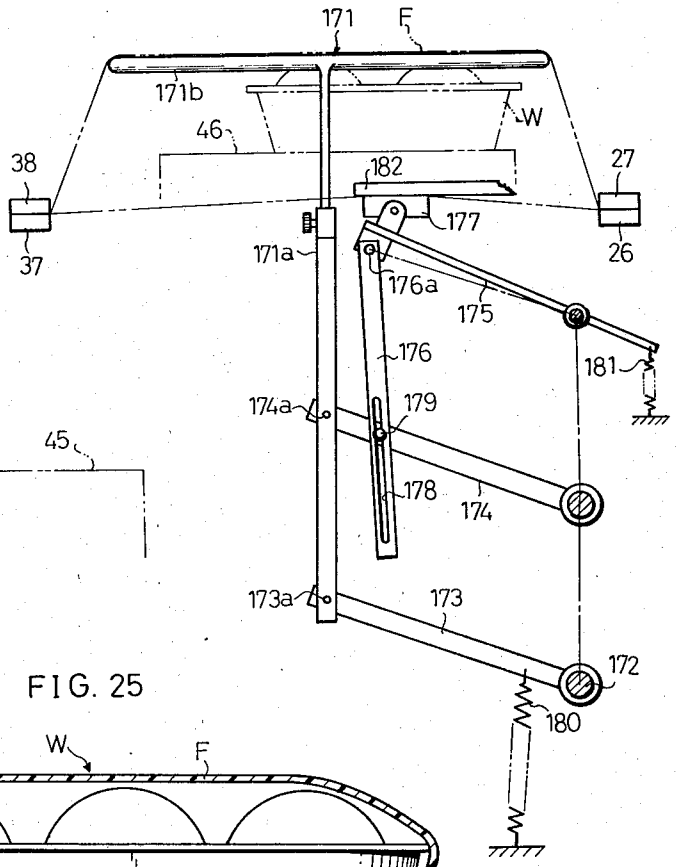

Next, as shown in FIG. 20, the delivery means 46 is moved upwardly so that the object W is brought into contact with the wrapping film F, and as shown in FIG. 21, the frame 171*b* of the push-up member 171 is separated from the film F, whereby the object W is wrapped with the film F. At this time, the object W is pressed from the upper side thereof by means of the stretched film F. However, since the film F normally shrinks only very slightly in a short period of time from the time when it is stretched by the upward movement of the frame 171*b* to the time when the wrapping operation is completed, the object W is not subjected to a very large pressing force. The right and left pressing members 177 are separated from the corresponding pressure-receiving plates 182 in response to the downward movement of the frame 171*b*. In consequence, the right and left edges of the film F are released from the clamping, this further reduces the pressing force of the film F applied to the object W.

Since the wrapping film F is not directly pushed by the object W but indirectly pushed up utilizing the push-up member 171 exclusively used therefor, there is no risk of the tray W1 being deformed to crush soft contents thereof when wrapped with the film F even if the tray W1 is flexible or has a relatively large height. Further, the right and left pressing members 177 move toward and away from the corresponding pressure-receiving plates 182 in response to the vertical movement of the push-up member 171. It is therefore possible to easily set the clamping or unclamping timing of the right and left pressing members 177 in response to the movement of the frame 171*b* when pushing up or separating from the wrapping film F with a simple structure, and it is possible for the right and left pressing members 177 to satisfactorily perform their functions in association with the frame 171*b*.

Thereafter, when the interlocking rod 96 is moved downwardly in response to the upward movement of the delivery means 46, the rear folding member 77 at its retracted position is advanced. As the member 77 is advanced, the respective guide edges 156 of the mounting members 151 are pushed inwardly against the urging force of the spring 154 by means of the guide pieces 155 on the rear folding member 77, and the mounting members 151 are thereby moved toward each other. The mounting members 151 push the film F toward the lower side of the object W on the mounts of the delivery means 46 and abut against the mounts at a position spaced slightly downwardly from the undersurface of the tray W1 so as to tilt the mounts. The mounting members 151 then enter the space underneath the object W and mount the same, as shown in FIG. 22.

Figure 23:
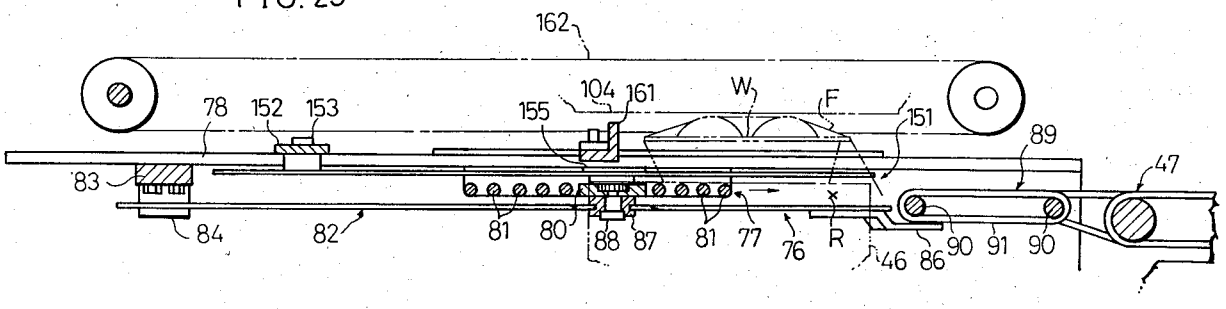

In response to the advance of the rear folding member 77, the right and left folding members 82 are also moved toward each other slightly after the above movement of the mounting members 151. Then, the rear folding member 77 and the right and left folding members 82 enter the space underneath the object W in a manner similar to that of the mounting members 151. When the rear folding member 77 has sufficiently entered the space underneath the object W as shown in FIG. 23, the mounting members 151 are moved away from each other by the urging force of the spring 154 and the shape of surface 156 as shown in FIG. 13 so as to separate from the object W, thus causing the object W to be placed on the rear folding member 77.

When the delivery means 46 is moved downwardly again, the rear and both lateral edges of the wrapping film F are gathered together tightly underneath the object W which is still mounted on the rear folding member 77 so that the film F is folded around the object W. In synchronism with this folding operation, the film F is released from the clamping effected by the center and side pressing portions 37*a*, 37*b* of the rear pressing member 37 and the side pressing portions 26*b* of the front pressing member 26 and is clamped by the center pressing portion 26*a* of the front pressing member 26 alone.

As described above, the mounting members 151 enter the space underneath the object W in advance so as to mount both lateral end portions of the underside of the object W, and after the rear folding member 77 has sufficiently entered the space underneath the object W, the object W is transferred from the mounting members 151 to the rear folding member 77. Then, the wrapping film F is folded around the object W by the rear folding member 77 and the right and left folding members 82. There is therefor no risk of the rear folding member 77 colliding with the rear edge of the underside of the object W. In addition, even if the mounts of the delivery means 46 tilt, there is no possibily of the object W oscillating sidewards or sliding into the rear folding member 77 so as to slant. Thus, the stability of the object W is improved.

Figure 25:
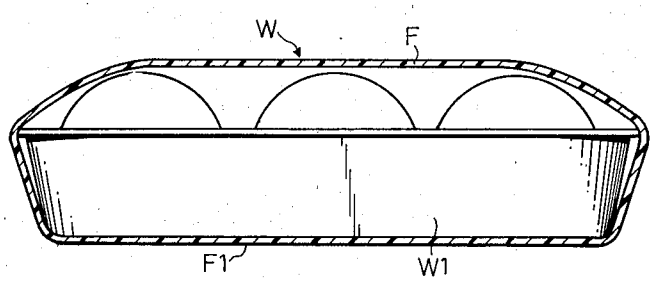
FIG. 25 is a sectional view showing an object wrapped with wrapping film.
Figure 24:
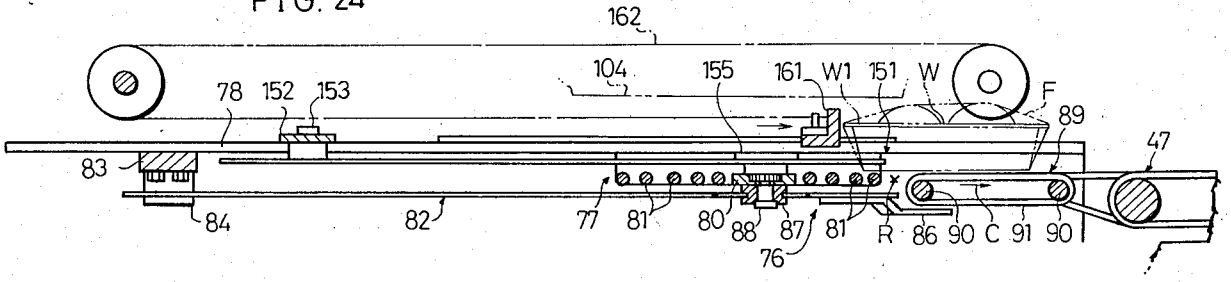

During the folding operation, the push-out member 161 advances so as to come close to the object W. When the push-out member 161 further advances to push out the object W, the film F is released from the clamping effected by the center pressing portion 26*a* of the front pressing member 26, and the belt 104*a* is started to rotate. The object W is transported forwardly by the advancement of the push-out member 161 in a state wherein the object W is separated from or in contact with the belt 104*a*. Then, as shown in FIG. 24, the object W is transferred from the rear folding member 77 to the front folding member 89 while being supported by the belt 104*a* from the upper side thereof so as to be prevented from oscillating. In the course of this transfer, the wrapping film F abuts against the front folding member 89 underneath the object W and is thereby folded from the front side thereof. Thus, the portions of the film F which are folded from the right and left sides of the object W are overlaid on the portion of the film F folded from the rear side of the object W, and the portion of the film F folded from the front side of the object W is further laid thereon, thereby forming a fold portion F1 underneath the object W, as shown in FIG. 25. Then, the interlocking rod 96 is moved upwardly again, and the rear folding member 77 is thereby retracted. In response to the retraction of the member 77, the right and left folding members 82 are opened or separated from each other, and the push-out member 161 is also retracted.

Since the belt 104*a* is not employed for transporting the object W but used for simply supporting the object W from the upper side thereof and the object W is transported by the push-out member 161, there is no risk of the tray W1 being deformed to crush soft contents thereof when wrapped even if the tray W1 is flexible or has a relatively large height.

After being wrapped, the object W is delivered to a heater means 47 where the fold portion F1 is bonded, thus completing one wrapping process.

It is possible according to the present invention to eliminate the risk of the tray W1 being deformed to crush soft contents thereof when wrapped even if the tray W1 is flexible. Accordingly, it is possible to maintain and improve the value of commodities as well as stabilize the object W when folded with the wrapping film F.

Although the present invention has been described through specific terms, it is to be noted here that the described embodiment is not exclusive and various changes and modifications may be imparted thereto without departing from the sprit of the invention and the scope thereof which is limited solely by the appended claims.

What is claimed is:

1. A wrapping machine comprising:

(a) an elevator for raising an object into a horizontally held wrapping film;

(b) front and rear folding members movable relative to each other in the longitudinal direction of said machine to fold the film under said object;

(c) a pair of lateral folding members respectively disposed below and on both lateral sides ,of said rear folding member and supported so as to be moved laterally, said lateral folding members being opened and closed with respect to each other in response to the longitudinal movement of said rear folding member;

(d) a folding area defined between said front and rear folding members and said pair of lateral folding members, in which folding area the edge portions of a piece of wrapping film are gathered together tightly underneath an object to be wrapped in a state wherein all of said folding members are in close proximity with each other; and (e) a pair of mounting members positioned above said pair of lateral folding members and above said rear folding member and entering the space underneath said object to support the same before all of said folding members enter the space underneath said object so as to fold said film.

2. A wrapping machine according to claim 1, further comprising a pair of rails between which are stretched said front and rear folding members and a support member for supporting the respective proximal ends of said pair of lateral folding members.

3. A wrapping machine according to claim 2, wherein said rear folding member includes a pair of sliders respectively positioned at both lateral sides thereof, said sliders being longitudinally movably supported on said rails, respectively, and a guide member stretched between said sliders.

4. A wrapping machine according to claim 3, further comprising another support member stretched between said pair of rails and between said first support member and said guide member, said second support member supporting the respective proximal end portions of said pair of mounting members so that said mounting members are pivotal laterally, between which proximal end portions is stretched a spring for constantly urging said mounting members in the direction in which they are opened or separated from each other.

5. A wrapping machine according to claim 4, wherein said guide member has a pair of guide pieces on its upper surface, said guide pieces being engaged with the respective outer guide edges of said mounting members so that said guide pieces move forwardly while being engaged with said mounting members in response to the forward movement of said guide member, thereby urging said mounting members in the direction in which they are closed or moved toward each other against the resiliency of said spring.

6. A method of folding wrapping film in a wrapping machine, said method comprising:

(a) a step of stretching a piece of wrapping film over a wrapping area;

(b) a step of pushing up an object to be wrapped from the lower side of said piece of wrapping film, thereby covering said object with said piece of wrapping film from the upper side thereof;

(c) a step of closing a pair of mounting members with respect to each other, said mounting members being able to be opened and closed with respect to each other, in a state wherein said object is covered with said piece of wrapping film, whereby said mounting members enter the space underneath said object to support said object thereon through said piece of wrapping film;

(d) a step of opening or moving said mounting members away from each other so as to separate from said object;

(e) a step of moving a rear folding member positioned below said mounting members so as to enter the space underneath said object as said mounting members separate from said object, whereby said object is transferred from said mounting members to said rear folding member, and at the same time, said object is placed on said rear folding member through said piece of wrapping film;

(f) a step of moving said rear folding member and a pair of lateral folding members under said object so that the rear and both lateral edge portions of said piece of wrapping film are gathered together tightly underneath said object; and (g) a step of pushing out said object forwardly so as to be transferred to a front folding member so that said piece of wrapping film is also folded from the front side thereof by said front folding member, whereby the portions of said film folded from both lateral sides are overlaid on the portion of said film folded from the rear side, and the portion of said film folded from the front side is further laid thereon.

* * * * *